US008122947B2

(12) United States Patent
Al-Otaibi

(10) Patent No.: US 8,122,947 B2
(45) Date of Patent: Feb. 28, 2012

(54) TURBULENT DEVICE TO PREVENT PHASE SEPARATION

(75) Inventor: Abdullah M. Al-Otaibi, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 1099 days.

(21) Appl. No.: 11/998,343

(22) Filed: Nov. 29, 2007

(65) Prior Publication Data

US 2009/0141585 A1 Jun. 4, 2009

(51) Int. Cl.
*E21B 21/06* (2006.01)
*B01F 5/00* (2006.01)
*B01F 3/08* (2006.01)

(52) U.S. Cl. ..... 166/75.12; 366/336

(58) Field of Classification Search ..... 366/336, 366/337, 338; 166/75.12
See application file for complete search history.

(56) References Cited

U.S. PATENT DOCUMENTS

| | | | | |
|---|---|---|---|---|
| 1,678,225 | A | 7/1928 | Kincade | |
| 2,576,733 | A * | 11/1951 | Vasold | 366/337 |
| 3,167,305 | A * | 1/1965 | Backx et al. | 366/338 |
| 4,083,660 | A | 4/1978 | Newbrough | |
| 4,099,268 | A | 7/1978 | Luthi | |
| 4,164,375 | A | 8/1979 | Allen | |
| 4,725,287 | A | 2/1988 | Gregoli et al. | |
| 4,874,249 | A | 10/1989 | Kabatek et al. | |
| 5,145,256 | A | 9/1992 | Wiemers et al. | |
| 5,302,325 | A * | 4/1994 | Cheng | 261/76 |
| 5,597,236 | A | 1/1997 | Fasano | |
| 5,810,052 | A | 9/1998 | Kozyuk | |
| 5,971,603 | A | 10/1999 | Davis et al. | |
| 6,467,949 | B1 | 10/2002 | Reeder et al. | |
| 6,637,928 | B2 | 10/2003 | Schuchardt | |
| 7,160,024 | B2 | 1/2007 | Dougherty, Sr. et al. | |
| 7,762,715 | B2 * | 7/2010 | Gordon et al. | 366/176.1 |
| 2009/0141585 | A1 * | 6/2009 | Al-Otaibi | 366/339 |

FOREIGN PATENT DOCUMENTS

| | | | |
|---|---|---|---|
| EP | 1036588 | A1 | 9/2000 |
| JP | 52039861 | A | 3/1977 |

OTHER PUBLICATIONS

International Search Report and Written Opinion dated Mar. 5, 2009, 13 pages.

* cited by examiner

*Primary Examiner* — Tony G Soohoo
(74) *Attorney, Agent, or Firm* — Bracewell & Giuliani LLP

(57) ABSTRACT

A mixer for use in a transmission pipeline and a wellbore fluids pipeline having a mixing device. The pipeline extends from a well head to a processing facility. The mixer perturbs the flow into a non-laminar state. Mixer embodiments include a body having a cone shaped leading edge and a hemi-spherical end. Other embodiments include a double cone having a series of helical fins on the trailing end of the double cone and fins extending perpendicular to the pipeline axis having a triangular cross section. The fins may be staggered with a mix of vertically and horizontally orientations.

15 Claims, 5 Drawing Sheets

TURBULENT DEVICE TO PREVENT PHASE SEPARATION

BACKGROUND OF THE INVENTION

1. Field of the Invention

This disclosure generally relates to the field of transmitting produced fluids extracted from a subterranean wellbore. The disclosure more specifically relates to a pipeline for transmitting wet crude with a mixing device for sustaining an oil and water emulsion within the wet crude.

2. Description of the Related Art

Crude oil from a subterranean formation generally comprises water along with liquid hydrocarbons. Crude oil having a discernable water fraction is herein referred to as wet-crude. After being extracted from the formation, the wet crude is transmitted to a processing facility typically through one or more transmission pipelines. Examples of a processing facility include refineries, water separation units, treatment facilities, and any other unit that refines or otherwise treats the crude oil. While flowing through the pipeline, the wet crude flow regime generally remains in a laminar flow region.

Transmission pipelines typically extend in a horizontal orientation that can run for many miles. The pipelines' long run combined with the wet crude laminar flow allows water to separate from the crude oil and contact the inner pipeline surface. Since the common material for pipelines is carbon steel, being directly subjected to a water fraction over time will corrode the inside of the pipeline. This may be exacerbated in situations when the water has a high metal salt content. This problem has been addressed by either providing a coating on the inner surface of the piping as well as injecting additives into the wet crude to maintain the water fraction in solution and dispersed within the crude fraction.

SUMMARY OF THE INVENTION

Disclosed herein is a method for transmitting a wellbore fluid through a pipeline, wherein the wellbore fluid comprises wet crude having liquid hydrocarbon and water. The method comprises directing a controlled stream of the wellbore fluid into the pipeline to produce a flowfield of wellbore fluid through the pipeline and creating non-laminar flow of the wellbore fluid in at least a portion of the pipeline with a mixing device. Use of the mixing device forms a sustaining water-in-oil emulsion of the wellbore fluid. The mixing device is disposed in the wellbore fluid flowpath and comprises a member within the pipeline. The member comprises a leading edge with a tip at one end and a crest at another end, the contour of the member between the tip and the crest being largely non-parallel to the pipeline, and wherein the member cross-section increases with distance away from the tip. The member also may comprise a rear or trailing end comprising a hemi-sphere, a body having fins helically arranged on its outer surface, a body having a terminal end substantially perpendicular to the pipeline axis, or combinations thereof.

Also disclosed herein is a pipeline for transmitting wet crude. The pipeline comprises an inlet in fluid communication with a hydrocarbon producing wellhead, wherein the inlet is formed to receive wellbore fluid from the wellhead thereby creating wellbore fluid flowfield in the pipeline. The wellbore fluid comprises wet crude having liquid hydrocarbon and water. The pipeline includes an exit in fluid communication with a wellbore fluid processing facility and a mixing device. The mixing device comprises a mixing member having a front end and a backend disposed downstream of the front end. The front end converges to a point at its leading edge and has a cross sectional area that increases with distance from the leading edge to the backend. Flowing wellbore fluid across the mixing member trips the wellbore fluid flowfield into a non-laminar state and suspends the water within the liquid hydrocarbon. In one embodiment, the front end comprises a cone and the backend comprises a shape selected from the group consisting of a hemi-sphere and a cone having helically disposed fins thereon. Optionally, the pipeline may comprise multiple members in its mixing device, where the members have a front end with a triangular cross section and a substantially planar backend that is perpendicular to the pipeline axis. The members may be vertically oriented members, horizontally oriented members, or a combination. The members may be arranged in rows that are disposed at different axial locations in the pipeline, wherein members of one row are staggered with respect to members of another row. The pipeline may include more than one mixing device.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAIL DESCRIPTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

The method and device disclosed herein provides a manner of transmitting produced wet crude through a pipeline, wherein the fluid contains a hydrocarbon and a liquid water fraction. During the fluid transmission, the method maintains the water fraction in the wet crude. More specifically, the system and method included herein incorporates a mixing device within the pipeline, wherein the mixing device perturbs the wellbore fluid into a non-laminar flow regime. The step of perturbing the wellbore fluid flow prevents water within the wet crude from coalescing and separating from within the hydrocarbon fraction thereby substantially reducing direct exposure of the inner surface of a pipeline with water contained in wet crude.

Figure 1:
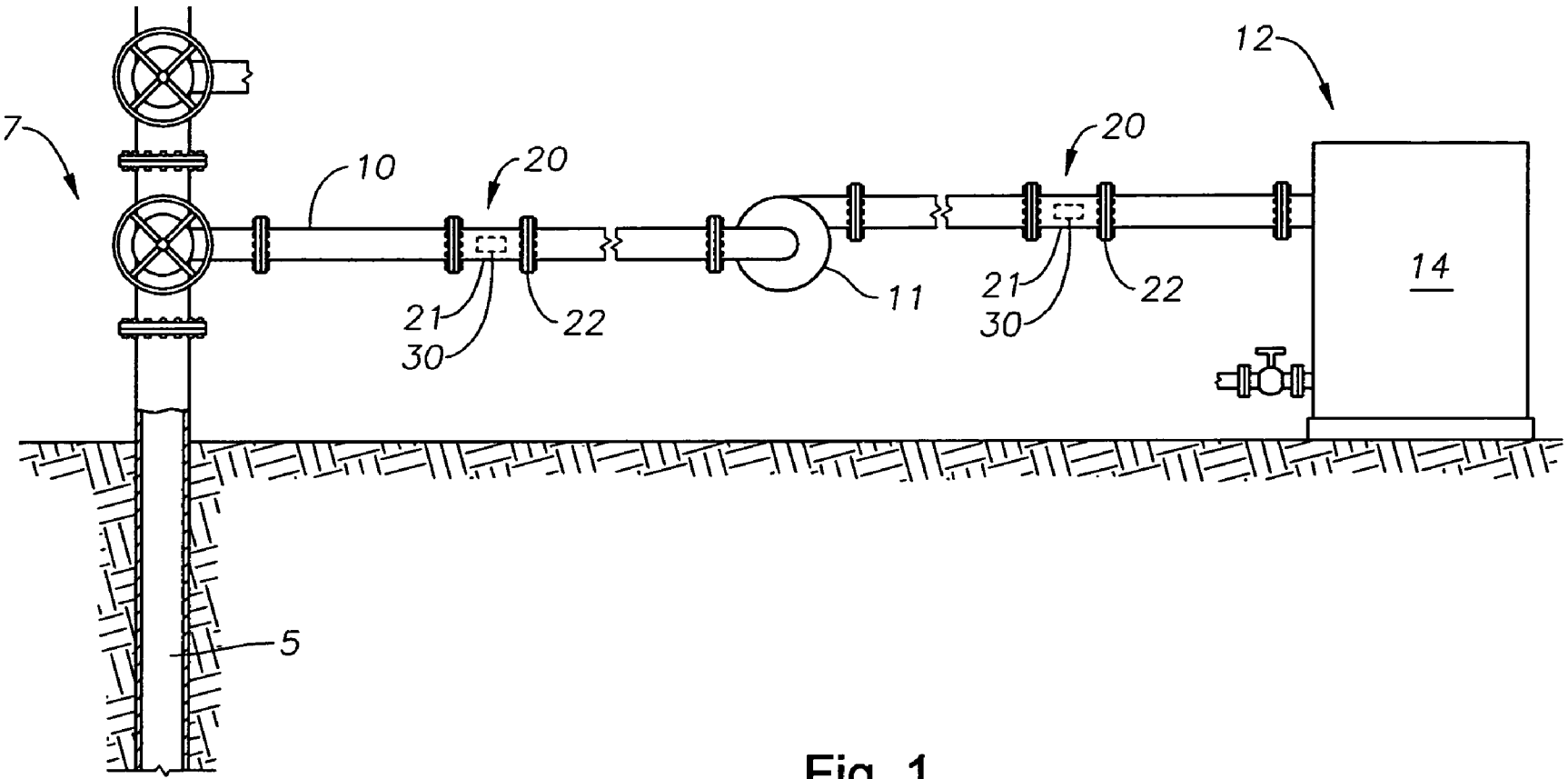
FIG. 1 is a schematical view illustrating flow of wellbore fluid to the wellhead and pipeline and to a processing facility.

With reference now to FIG. 1, one embodiment of a transmission system for transmitting a wellbore fluid is shown. In this embodiment, wellbore fluid, that comprises wet crude, is being produced from within a wellbore 5, directed through a wellbore assembly 7, and directed into a pipeline 10. Thus, the pipeline 10 entrance is connected with the wellhead assembly 7. The pipeline 10 may include one or more pumps 11 for pumping the wellbore fluid within the pipeline 10 to its terminal destination. In the embodiment of FIG. 1, the terminal destination comprises a processing facility 12. Facility equipment 14 is shown connected to the terminal end of the pipeline 10, the facility equipment 14 may be any type of fluids handling equipment. Examples of facility equipment includes a heat exchanger, a separator, a coalescer, and rotating equipment, such as a pump.

Also included within the pipeline 10 is a mixing device 20 having a mixing member 30 therein shown in a dashed outline. For the purposes of disclosure herein, the outer housing of the mixing device 20 is referred to as a spool 21, wherein the spool is coupled with the remaining portion of the pipeline 10 via respective flanges 22. Thus when disposed within the pipeline 10, the spool 21 may be considered as part of the pipeline 10.

Figure 2B:
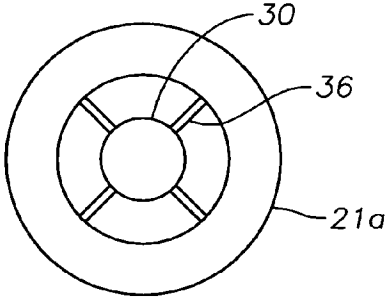
FIG. 2*b* is an axial view of the mixing device of FIG. 2*a*.
Figure 2A:
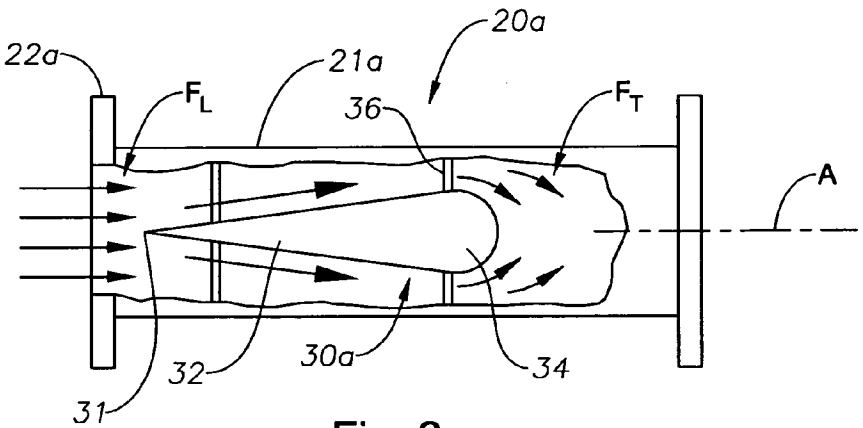
FIG. 2*a* is a side partial cross sectional view of an embodiment of a mixing device.

FIGS. 2*a* and 2*b* illustrate in a side and an end view an embodiment of a mixing device 20*a*. The mixing device 20*a* comprises a spool 21*a* flanked by flanges 22*a*. The flanges 22*a* provide a connection means for connecting the mixing device 20*a* within an associated pipeline. The mixing device 20*a* includes a mixing member 30*a* having a front end 32 and a rear end 34. The front end 32 cross-sectional area increases with distance from the tip 31 of its leading edge along its length. Along the increase the front end 32 has a profile angled (not parallel) with the spool 21*a* inner circumference. One embodiment of supports 36 illustrates structural members that support the mixing member 30*a* within the spool 21*a*. The supports 36 also orient the mixing member 30*a* within a flow field of wellbore fluid flow. Fluid flow is illustrated by arrows on the upstream portion of the mixing device 20*a*.

The front end 32 comprises a generally conical shape converging to a tip 31 at a forward portion of its leading edge and a rear end 34 (also referred to as a trailing edge) with a generally semi-hemispherical shape. In the embodiment shown, the mixing member 30*a* is oriented so the leading edge is directed opposite the fluid flow direction. Accordingly, particles in the fluid flow encounter the leading edge before passing over the remaining portion of the mixing member 30*a*. Flow arrows depicting a flow path over the member 30*a* are directed around the outer surface of the flow member 30*a* at an angle oblique to the axis of the mixing device 20*a*.

In one mode of operation, fluid entering the mixing device 20*a* is in a generally laminar flow regime. The laminar flow regime is illustrated by the uniform length and distribution of the arrows proximate to the entrance flange 22*a*. The flow field here is denoted by $F_L$, where the subscript "L" represents laminar flow. As noted above, upon reaching the front end 32 the flow field splits and flows along the outer surface of the mixing member 30. The region where the mixing member 30 cross sectional area is at a maximum is referred to as its crest. Along the crest region the annulus area between the mixing member 30 outer surface and spool 21*a* inner diameter is minimized thus producing a localized maximum in fluid velocity. The flow field redirection by the front end 32 is relatively gradual. In contrast, as the flow passes across the rear end 34, its profile abruptly truncates which creates a low pressure field just downstream of the rear end 34. The low pressure field directs the flow field towards the mixing device 20*a* axis A. The abrupt redirection of flow thereby trips the flow field from a laminar state into a non-laminar state and sufficiently perturbs the wet crude to suspend its water fraction therein. The flow field is identified by $F_T$, where the subscript "T" represents transitional flow. Moreover, the non-laminar transition sustains the water and oil emulsion of the wellbore fluid within the pipeline having the mixing device.

Figure 3B:
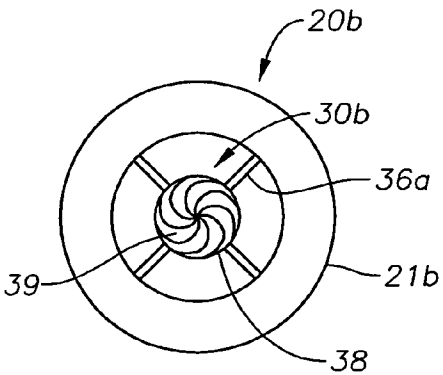
FIG. 3*b* is axial view of the mixing device of FIG. 3*a*.
Figure 3A:
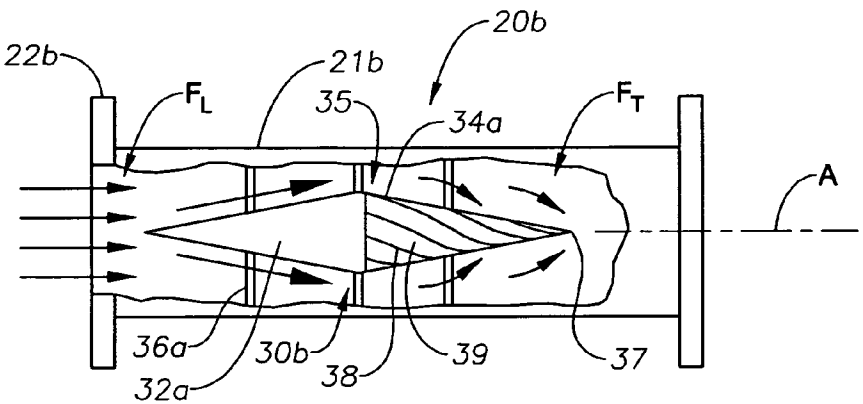
FIG. 3*a* is a side partial cross sectional view of an embodiment of a mixing device.

FIG. 3*a* illustrates in side cross sectional view another embodiment of a mixing device 20*b* comprising a mixing member 30*b* coaxially disposed within a spool piece 21*b*. Flanges 22*b* are disposed on the ends of the spool piece 21*b*. The mixing member 30*b* comprises a front end 32*a* and a rear end 34*a*. The front end and rear end (32*a*, 34*a*) both have a substantially conical shape and are mated at their respective base ends. Supports 36*a* extend from the spool 21*b* to the outer surface of the mixing member 30*b* for maintaining the mixing member 30*b* within the wellbore fluid flow. Fins 38 are helically arranged on the rear end 34*a*. The fins 38 each have a width that exceeds its thickness and form corresponding helical channels 39 that run from the base 35 of the rear end 34*a* toward the downstream tip 37 of the mixing member 30*b*. The helically shaped channels 39, in combination with the alternating higher fluid velocity adjacent the front end/back end juncture, creates a fluid mixing zone downstream of the mixing member 30*b*. As noted above, the zone produces a perturbing mixing action and may trip laminar fluid flow into non-laminar flow that suspends the water components within the liquid hydrocarbon. FIG. 3*b* is a view from downstream of the mixing member 30*b* illustrating a fin arrangement.

Figure 4B:
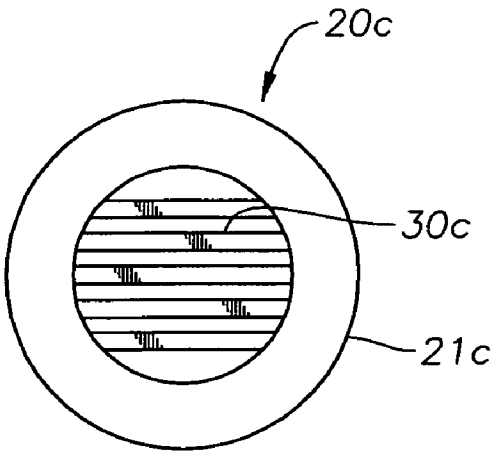
FIG. 4*b* is an axial view of the mixing device of FIG. 4*a*.
Figure 4A:
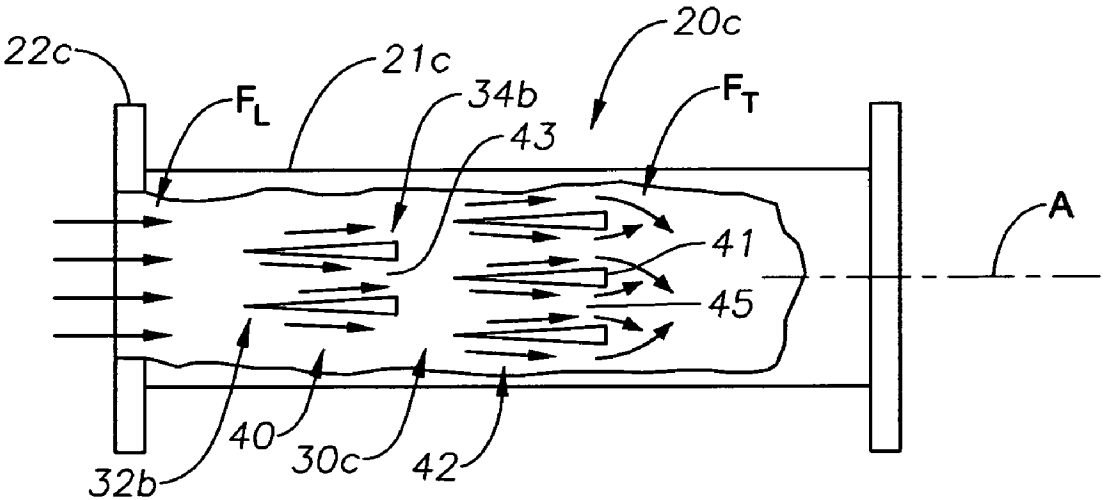
FIG. 4*a* is a side cross sectional view of an embodiment of a mixing device.

FIG. 4*a* illustrates yet another embodiment of a mixing device 20*c* having a mixing member 30*c* disposed within a spool 21*c*. The spool includes flanges 22*c* on its ends for connection within an associated pipeline. The mixing member 30*c* of FIG. 4*a* is not a single member but comprises multiple mixing members 41. These members 41 are arranged in a forward row 40 and a rearward row 42. The forward row 40 comprises members disposed within the mixing device 20*c* upstream of the rearward row 42. Each member 41 comprises a front end 32*b* and a rear end 34*b*, wherein the front end 32*b* has a generally triangular cross section that increases in height and area with distance away from the leading edge of the front end 32*b*. The rear end 34*b* terminates in a generally planar configuration at the downstream end of the member 41. Similar to the other mixing members, the gradual widening of the mixing members 41 directs flow away from its middle and then the abrupt absence of material allows for a low pressure zone downstream of the member. The low pressure zone draws in flow elements from the flow field thereby providing a mixing effect in the zone.

In the embodiment of FIG. 4*a*, the forward row 40 is staggered with respect to the rearward row 42. That is, at least one member of the rearward row 42 is aligned with a gap 43 separating members 41 of the forward row 40. Similarly a member of the forward row 40 is aligned with a gap 45 separating members 41 of the rearward row 42. Accordingly, enhanced mixing and perturbation is produced by staggering members of adjacent rows and aligning a member of a row with a gap of an adjacent row. Optionally, additional rows of individual mixing elements may be included within this mixing device. However the mixing device 20*c* is not limited to staggered adjacent rows, but includes adjacent rows having members substantially aligned with one another. Although the members 41 are shown as aligned with the spool axis, they can be oriented at an angle to the axis. This orientation applies to any of the mixing members disclosed herein. FIG. 4*b* provides an axial view of the mixing member 30*c* of FIG. 4*a* depicting the generally horizontal arrangement of the individual elements 41 along the height of the spool 21*c*.

Figure 5C:
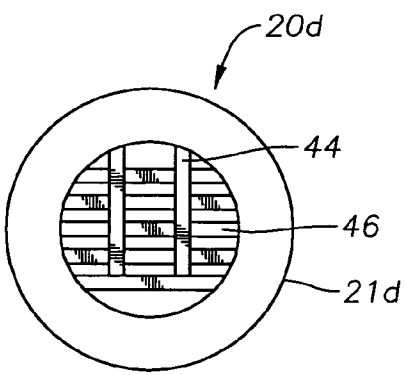
FIG. 5*c* is an axial view of the mixing device of FIGS. 5*a* and 5*b*.
Figure 5A:
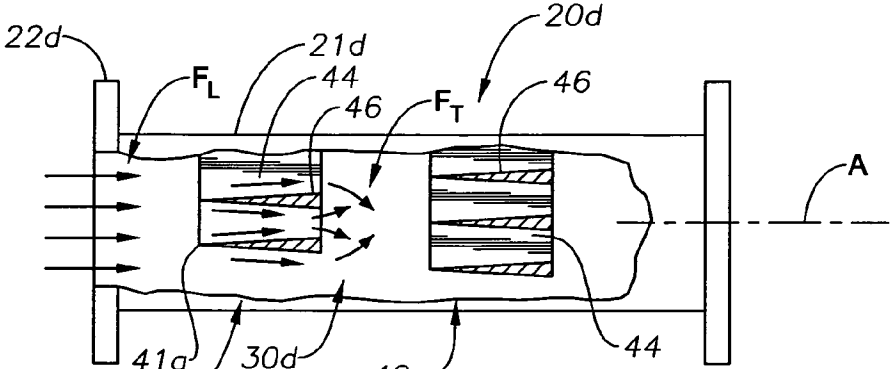
FIG. 5*a* is a side partial cross sectional view of an embodiment of a mixing device.
Figure 5B:
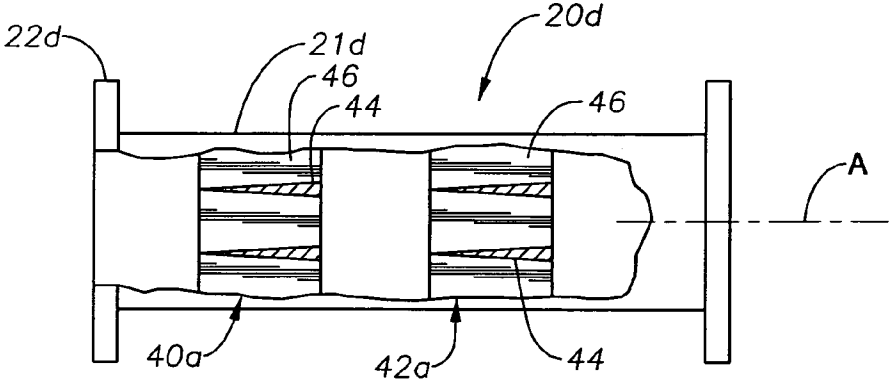
FIG. 5*b* is an overhead view of the mixing device of FIG. 5*a*.

FIGS. 5*a* and 5*b* illustrate a side overhead and an axial view of a mixing device 20*b* having individual mixing members 41*a* disposed within the device. The mixing device 20*d* is equipped with flanges 22*d* on its ends for attachment within a pipeline. Some of the members 41*a* are vertically arranged and some are horizontally arranged. With reference now to FIG. 5*a*, the mixing device 20*b* comprises a forward row 40*a* and a rearward row 42*a*, each row (40*a*, 42*a*) comprises vertical elements 44 intersecting horizontal members 46. FIG. 5*a*, which is a side view of the mixing device 20*d*, illustrates that the horizontal members 46 are staggered with respect to corresponding horizontal members 46 of the different row. FIG. 5*b*, which is an overhead cross sectional view of the mixing device 20*d*, illustrates that the vertical members 44 are generally aligned with corresponding elements from different rows. Optionally, the vertical members may be staggered with the horizontal members aligned, the horizontal and vertical members may be staggered, or the horizontal and vertical members may be aligned. Further illustrating the cross hatch arrangement of the vertical and horizontal members (44, 46), FIG. 5*c* illustrates an axial view of the mixing device 20*d* circumscribed by the spool 21*d*.

Figure 6A:
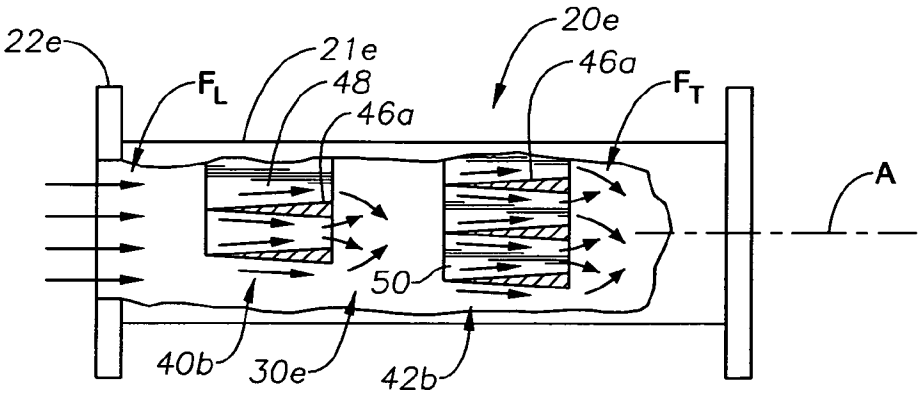
FIG. 6*a* is a side partial cross sectional view of an embodiment of a mixing device.
Figure 6B:
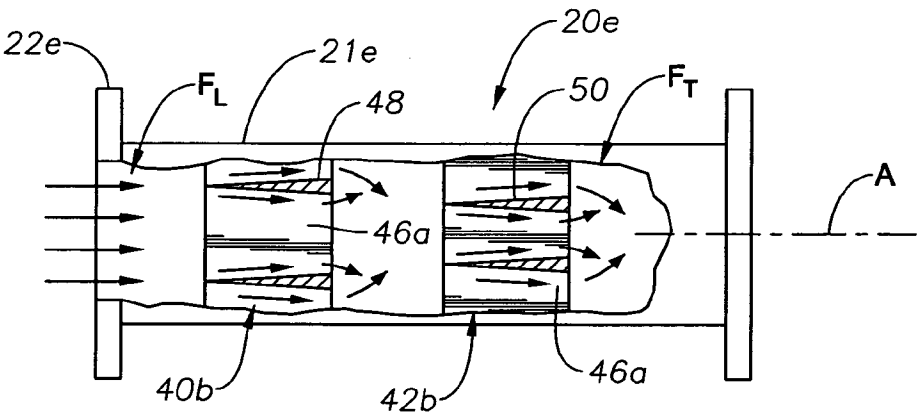
FIG. 6*b* is an overhead view of the embodiment of the mixing device of FIG. 6*a*.
Figure 6C:
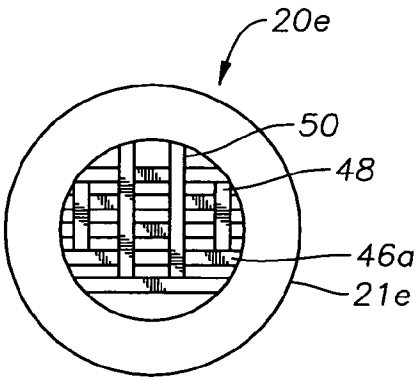
FIG. 6*c* is an axial view of the mixing device of FIGS. 6*a* and 6*b*.

FIGS. 6*a*-6*c* illustrate yet another embodiment of a mixing device 20*e*. In this embodiment, the mixing device comprises a mixing member 30*e* disposed within a spool 21*e* having flanges 22 at its respective ends. The mixing member 30*e* comprises mixing members, some of which are horizontal and some vertical. As illustrated by FIGS. 6*a* and 6*c*, vertical members (48, 50) are located at different distances lateral from the spool axis A. For example, an outer vertical element 48 is proximate to the outer radius of the spool 21*e* on either side of the mixing member 30*e* and inner vertical members 50 are disposed in closer proximity to the spool 21*e* axis A. Also, the inner vertical members 50 are longer than the outer vertical members 48. Horizontal elements 46 are horizontally arranged within the mixing device 20*e* at different elevations within the spool 21*e*. As seen in the side view of FIG. 6*a* and the overhead view of FIG. 6*b*, both the horizontal and vertical members the first row 40*b* are staggered with respect to the members of the second row 42*b*.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method for transmitting wet crude from a wellbore to a processing facility comprising:

providing a transmission pipeline between the wellbore and the processing facility;

directing a controlled stream of the wet crude from the wellbore into the pipeline to produce a flowfield of wellbore fluid through the pipeline; and creating a water-in-oil emulsion of the wellbore fluid by providing a mixing device in the pipeline and in a path of the wellbore fluid that comprises a member having a leading edge with a tip at one end and a crest at another end, the contour of the member between the tip and the crest being largely non-parallel to the pipeline, and wherein the member cross-section increases with distance away from the tip.

2. The method of claim 1, wherein the member is oriented so fluid components in the flowpath encounter the tip before encountering the crest.

3. The method of claim 1, wherein the member further comprises a trailing edge, wherein the trailing edge shape comprises a shape selected from the group consisting of a hemi-sphere, a body having fins helically arranged on its outer surface, and a body having a terminal end substantially perpendicular to the pipeline axis.

4. The method of claim 1 further comprising sustaining non-laminar flow in the pipeline with a second mixing device disposed in the flowpath downstream of the mixing device.

5. The method of claim 1, wherein the processing facility comprises a refinery.

6. The method of claim 1, further comprising additional members disposed at different axial locations within the pipeline.

7. The method of claim 6, wherein the members comprise a forward row at a forward axial location, and a rearward row that is disposed rearward of the forward row, and wherein the forward row is vertically staggered with respect to the rearward row.

8. The method of claim 7, wherein the forward row includes members oriented horizontally and members vertically oriented, and wherein the rearward row includes members oriented horizontally and members vertically oriented.

9. A pipeline for transporting fluid from a wellbore containing a hydrocarbon comprising:

an inlet connected to a wellhead mounted on the wellbore;

an exit connected to a piece of fluids handling equipment disposed in a wellbore fluid processing facility; and a mixing device disposed within the pipeline comprising a mixing member having a front end with a pointed leading edge directed into a flow of the fluid, a back end disposed downstream of the front end, and a body extending between the front and back ends and having a cross sectional area that increases with distance from the leading edge to the back end, so that when fluid from the wellbore includes water and flows through the mixing device, the mixing member trips a flow field of the wellbore fluid into a non-laminar state and suspend the water within the hydrocarbon.

10. The pipeline of claim 9, wherein the front end of the member comprises a cone and its backend comprises a shape selected from the group consisting of a hemi-sphere and a cone having helically disposed fins thereon.

11. The pipeline of claim 9 further comprising multiple members having a triangular cross section and a substantially planar backend that is perpendicular to the pipeline axis.

12. The pipeline of claim 11, wherein the members comprise vertically oriented members and horizontally oriented members.

13. The pipeline of claim 11, further comprising a front row comprised of a first set of members, and a rear row comprised of a second set of members, wherein the rear row is disposed downstream of the front row.

14. The pipeline of claim 11, wherein the members of the rear row and forward row are staggered.

15. The pipeline of claim 9 further comprising a second mixing device.

* * * * *